US011308791B2

(12) United States Patent
Chellappan et al.

(10) Patent No.: US 11,308,791 B2
(45) Date of Patent: Apr. 19, 2022

(54) METHODS, SYSTEMS AND APPARATUS TO USE AUDIO RETURN PATH FOR FUNCTIONAL SAFETY VALIDATION

(71) Applicant: Intel Corporation, Santa Clara, CA (US)

(72) Inventors: Satheesh Chellappan, Folsom, CA (US); Srikanth Potluri, Folsom, CA (US)

(73) Assignee: INTEL CORPORATION, Santa Clara, CA (US)

( * ) Notice: Subject to any disclaimer, the term of this patent is extended or adjusted under 35 U.S.C. 154(b) by 29 days.

(21) Appl. No.: 16/235,807

(22) Filed: Dec. 28, 2018

(65) Prior Publication Data

US 2019/0139399 A1 May 9, 2019

(51) Int. Cl.

| | |
|---|---|
| ***G08B 29/18*** | (2006.01) |
| ***G08B 3/10*** | (2006.01) |
| ***H04R 29/00*** | (2006.01) |

(52) U.S. Cl.

CPC ..... *G08B 29/18* (2013.01); *G08B 3/10* (2013.01); *H04R 29/001* (2013.01)

(58) Field of Classification Search

CPC ..... G08B 29/18; G08B 3/10; H04R 29/001
USPC ..... 340/501, 506, 511, 3.1
See application file for complete search history.

(56) References Cited

U.S. PATENT DOCUMENTS

| | | | | |
|---|---|---|---|---|
| 10,012,691 | B1 * | 7/2018 | Zhou | G01R 31/2856 |
| 10,459,684 | B2 * | 10/2019 | Shih | H04S 7/301 |
| 10,628,156 | B2 * | 4/2020 | Anderson | G06F 9/3893 |
| 2012/0223780 | A1 * | 9/2012 | Urakawa | H03K 3/0315 331/57 |
| 2015/0241553 | A1 * | 8/2015 | Gehrels | G01R 31/005 342/173 |

* cited by examiner

*Primary Examiner* — Daryl C Pope
(74) *Attorney, Agent, or Firm* — Spectrum IP Law Group LLC

(57) ABSTRACT

The disclosure generally provides methods, systems and apparatus for functional safety systems. Specifically, the disclosure relates to validating functional safety warnings that may be communicated to an operator. Such warnings may include safety warning chimes. An exemplary embodiment relates to an apparatus to validate operation of a Functional Safety (FuSa) platform through delivery of a safety warning signal, the apparatus comprising: a Safety Application to issue a safety warning signal, the safety warning signal configured for audio delivery to an audience; a transmit path in communication with the Safety Application to transmit the safety warning signal; and a digital signal processing (DSP) circuitry to communicate with the transmit path, the DSP circuitry configured to detect the safety warning signal at the transmit path, the DSP circuitry further configured to communicate the detected safety warning signal back to the Safety Application; wherein the transmit path, the Safety Application and the DSP circuitry are integrated on a System-on-Chip (SoC).

19 Claims, 5 Drawing Sheets

METHODS, SYSTEMS AND APPARATUS TO USE AUDIO RETURN PATH FOR FUNCTIONAL SAFETY VALIDATION

BACKGROUND

Functional Safety (FuSa) is the part of the overall safety of a system (or an equipment) that depends on the system's correct operation in response to its inputs. FuSa includes safe management of likely operator errors, hardware failures and environmental changes. The goal of FuSa is to arrange products in a way that they are verifiably free of unacceptable risks. Typical FuSa products are electronic systems which are used, for example, in vehicles, airplanes, hospitals or medical devices. Exemplary FuSa products include medical devices, robots and autonomous (or semi-autonomous) vehicles.

Self-test by software (SW), also known as Software Test Library (STL), is a method for providing diagnostic coverage for safety-related integrated circuits (ICs). An STL is an SW program which is periodically executed in the field by a processing unit. One goal of the STL is to act as an information provider. To this end, it may act as a bridge for diagnostic information. STLs are suitable for circuits that have either a limited, or no, hardware (HW) diagnostic measures. STLs may also be used to complement safety mechanisms of integrated circuits that have HW safety support.

Functional safety and other industrial and medical platforms need a reliable method to verify the delivery of, among others, safety warning signals. The safety warning signals include warning chimes. In the Internet of Things (IoT) platforms (e.g., autonomous driving vehicles and robots), FuSa needs to be built into the hardware architecture for reliable failure detection. Conventionally, audio feedback microphones have been used for such detections. Such systems are inadequate due to noise interference and may go unheard.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Conventional STLs include Intellectual Property (IP) core-based STL and Host-based STL of the FuSa products. As used herein, IP core is used interchangeably with core products or services offered by an SoC. Both STLs provide diagnostic test information locally in the system, platform or the SoC. The diagnostic test data is then presented to application layer of software that is running within the system or product. Conventional STLs do not allow the diagnostic test data to be externally harvested (e.g., presented to the cloud). For example, in a software defined cockpit product such as a car dashboard, an IP component may detect an error though its STL. The error is locally presented to the automotive dashboard to warn the user. Conventional STLs do not extend such STL data to external systems.

In conventional applications, using the automotive sector's FuSa STL solution, the safety concept determines that if an error is detected, the local warning system such as an audio chime is then triggered. If the error is correctable and none-severe, the driver may pull the car aside and reset or reboot the system to correct the error. For a more serious problem, the driver may have to send the car for service so that an in-house diagnostic test can determine the root cause. Conventional STLs do not allow live error harvesting. Instead, conventional STLs require timely diagnostic and troubleshooting which add to the cost of in-house testing at the service center. Similarly, if there is a hardware fault on a FuSa-enabled machine, the failure data cannot be collected remotely or dynamically.

The audio return path method is critical to FuSa goals. Currently there are no reliable hardware methods to detect audio warning chimes for FuSa in available SoC devices. As a result, FuSa is done either in firmware (FW) or SW. Certain disclosed embodiments allow determination of whether, for example, a Personal Assistance (PA) path, is turned On or Off. In certain embodiments, this can be done in HW or SW. In other embodiments, the disclosed applications may be implemented as firmware and/or on an SoC. The severity of the indication may be used to determine where the FuSa implementation must take place.

Other limitations in the conventional platform validation for converged audio voice and speech (cAVS) is the inability to get early coverage data during silicon power on. During early power-on, there are too many variables associated with each subsystem. As will be described, such variables include external audio devices, system topology and connector limitations. The variables are a hinderance to collecting coverage data during the start-up (bootup) phase. No SoC self-testing technique is currently available. The disclosed embodiments provide, among others, audio playback (transmit path) and audio capture (receive path) coverage for all audio input/output (IO), and the cAVS control and data paths.

Figure 1:
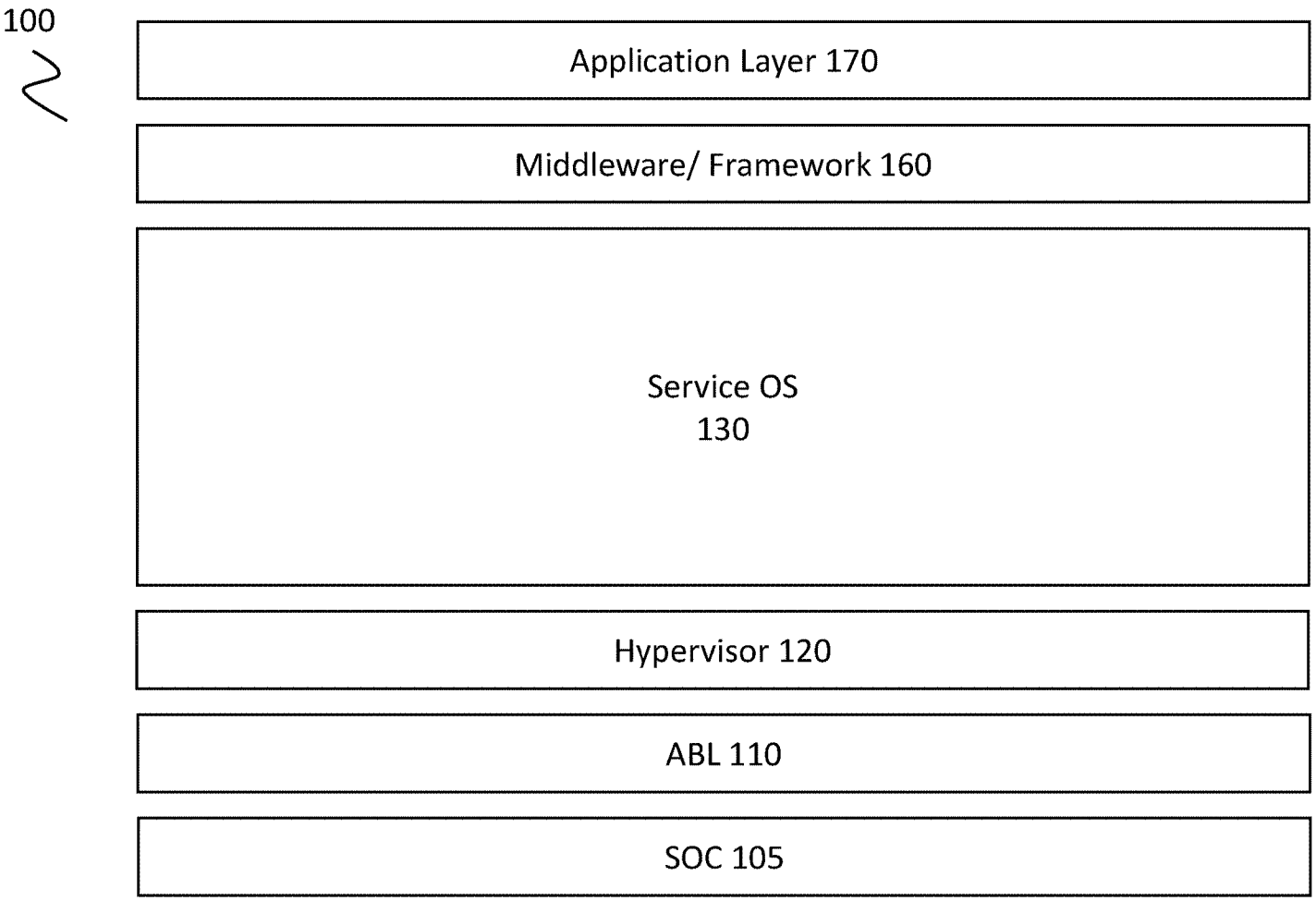
FIG. 1 is an exemplary software architecture to implement an embodiment of the disclosure.

FIG. 1 is an exemplary software architecture to implement an embodiment of the disclosure. Specifically, FIG. 1 shows software architecture for a Software Defined Cockpit (SDC), such as an automotive dashboard. SDC 100 may run on SoC 105 which supports various functionalities and services. SDC 100 is made up of several software layers that may provide the interface to the hardware SoC 105. It should be noted that while the following discussion relates to SoC, the disclosed principles are not limited to implementation on an SoC and may be applied to other onboard services, for example, integrated circuit, chipsets and other functions implemented on a chip or board.

SoC 105 may support various hardware processing units including, Graphic User Interphase (GPU) (not shown), audio (not shown) or other IP core functionalities. Automotive Bootloader (ABL) 110 may be integrated into SoC 105 to access information and to provide an in-vehicle compute module. ABL 110 may act as a basic I/O system (BIOS) that boots up the system 100. Hypervisor 120 may reside over ABL 110 and SoC 105 to manage various virtual machines for software processing. Service Operating Software (OS) 130 may include various operating and service functionalities. Layer 160 may comprise the middleware and framework functionalities. Layer 160 may be used to enable software communication and management of data in distributed applications. Finally, application layer 170 may provide an interface between the lower layers and the user.

In an exemplary embodiment, the disclosure provides a real-time FuSa-related feedback through an SoC. The feedback may, for example, confirm a safety chime display or a completed transmission of an audio safety warning. In another embodiment, the disclosure provides real-time confirmation feedback using SoC and its peripheral boards and devices. In still another embodiment, the disclosure relates to retiming the audio playback stream and loopback to the audio return channel of the same port in the receive path. This provides an audio stream integrity check for the transport paths (transmit and receive paths), the digital signal processing (DSP) components (Cores and FW) and various hardware resources in cAVS subsystem. The return channel may be enabled in all audio interfaces in cAVS IP. The audio stream pattern used for this method may be a conventional audio stream that can check for integrity at the receive side.

The disclosed embodiments provide numerous advantages over the conventional techniques. For example, in addition to functional validation and reliable detection of the FuSa audio warning chimes, the disclosed embodiments method can be applied for high volume manufacturing (HVM) sort and class validations. The audio return channel loopback is reliable and may be implemented within the SoC to eliminate the need for external board/chip level loopback. This is a significant improvement over the conventional FuSa methodology of over-the-air audio return channel through an external microphone which suffers from background noise, gain calibration and direct current (DC) offset issues.

Figure 2:
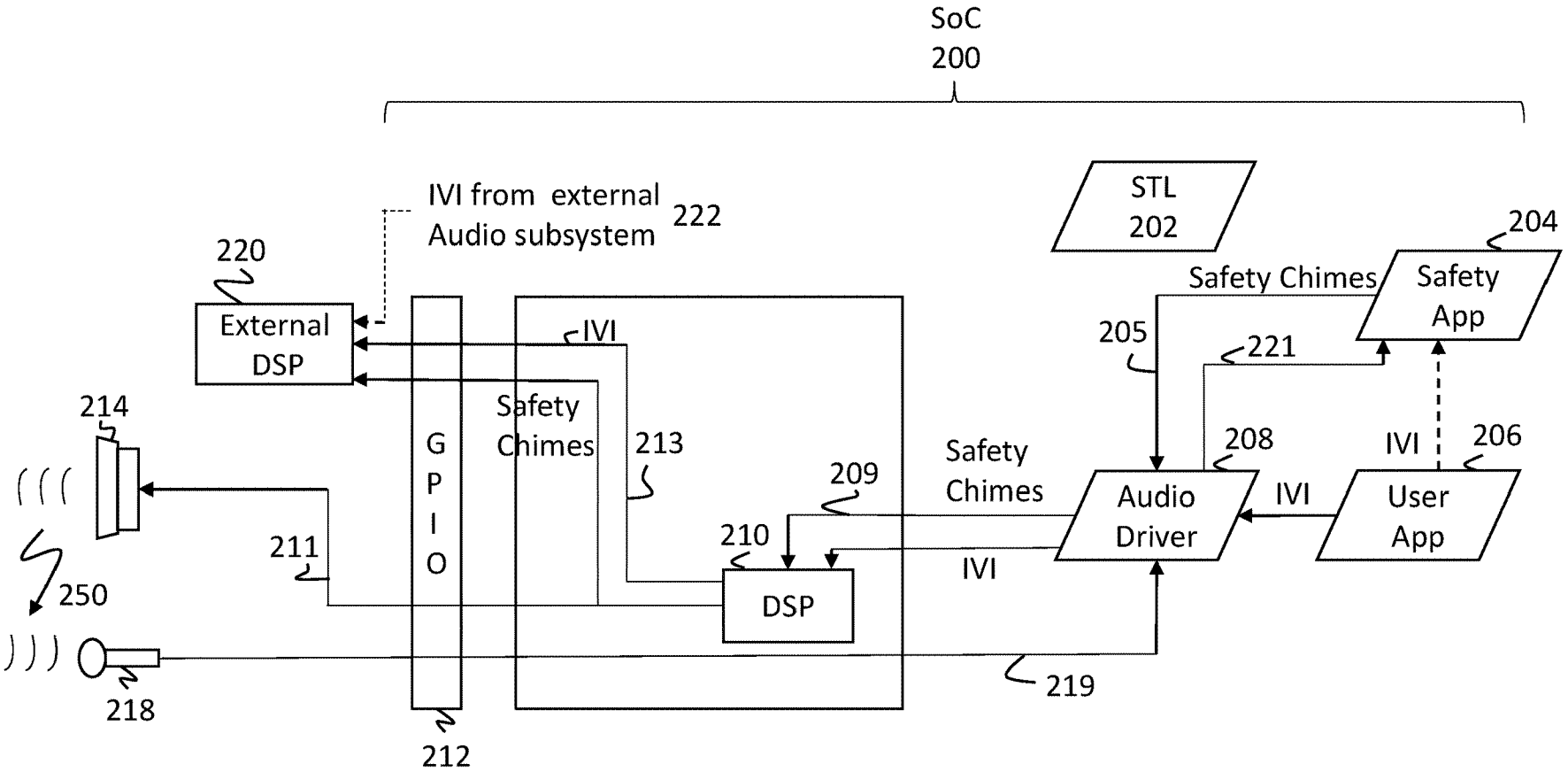
Fig. 2 (Prior Art)
FIG. 2 schematically illustrates a conventional feedback loop for a FuSa warning chime.

FIG. 2 schematically illustrates a conventional feedback loop for a FuSa warning chime. In FIG. 2, SoC 200 comprises STL 202, safety application 204, user application 206, audio driver 208, internal digital signal processor (DSP) 210 and general-purpose input/output (GPIO) 212. Upon occurrence of an event warranting FuSa communication, Safety App. 204 generates a signal to communicate with the user. In an exemplary embodiment, the signal may be a chime or a warning signal, though other signals, including video or light signals may be displayed. The safety signals (interchangeably, safety chimes) are transmitted from Safety App. 204 to audio driver 208 as shown by arrow 205. The safety signal may comprise a signal indicating or instructing the DSP 210 and speaker 214 to generate an audio signal to the user (not shown). The safety signal 205 may be a digital signal. Audio driver 208 relays a driving signal corresponding to signal 205 to DSP 210 as shown by arrow 209. DSP 210 may comprise one or multiple processors configured to process the received chime signal to generate, among others, an analog signal and communicate the same to speaker 214 via signal line 211. The same signal may optionally be routed to external DSP 220 via line 213. A system integrator may optionally use an external DSP. In some embodiments, the external DSP may be used for testing.

In FIG. 2, the FuSa warning signal or chime assumes the same communication path as that of an internal In-Vehicle Infotainment (IVI) signal 213. Accordingly, the transmit path is additionally identified as IVI 213. In addition, there may be an optional external (out of SOC) IVI which is identified by the dashed line 222.

The FuSa chime is played as an audio signal to the user or the passenger by speaker 214. To confirm delivery to the user or passenger, a return path is shown in FIG. 2 which includes microphone 218, audio driver 208 and safety app 204. Once the chime is played, microphone 218 detects the chime and communicates the signal to audio driver 208 as shown by arrow 219. Audio driver 208, then relays the signal to Safety App. 204 as shown by arrow 221. While not shown, the system may comprise an analog-to-digital converter to convert the analog audio signal to a digital signal.

As schematically illustrates in FIG. 2, the conventional techniques confirm the audio chime play through a microphone. Because the chime is played by speaker 214 which is also responsible for communicating the IVI signal (e.g., music or other infotainment signals), there is substantial likelihood that the warning chime may be drowned by background noise or suffer other interference. Thus, the confirmation of receipt of signal, as identified by path 250, may be not be effective.

Figure 3:
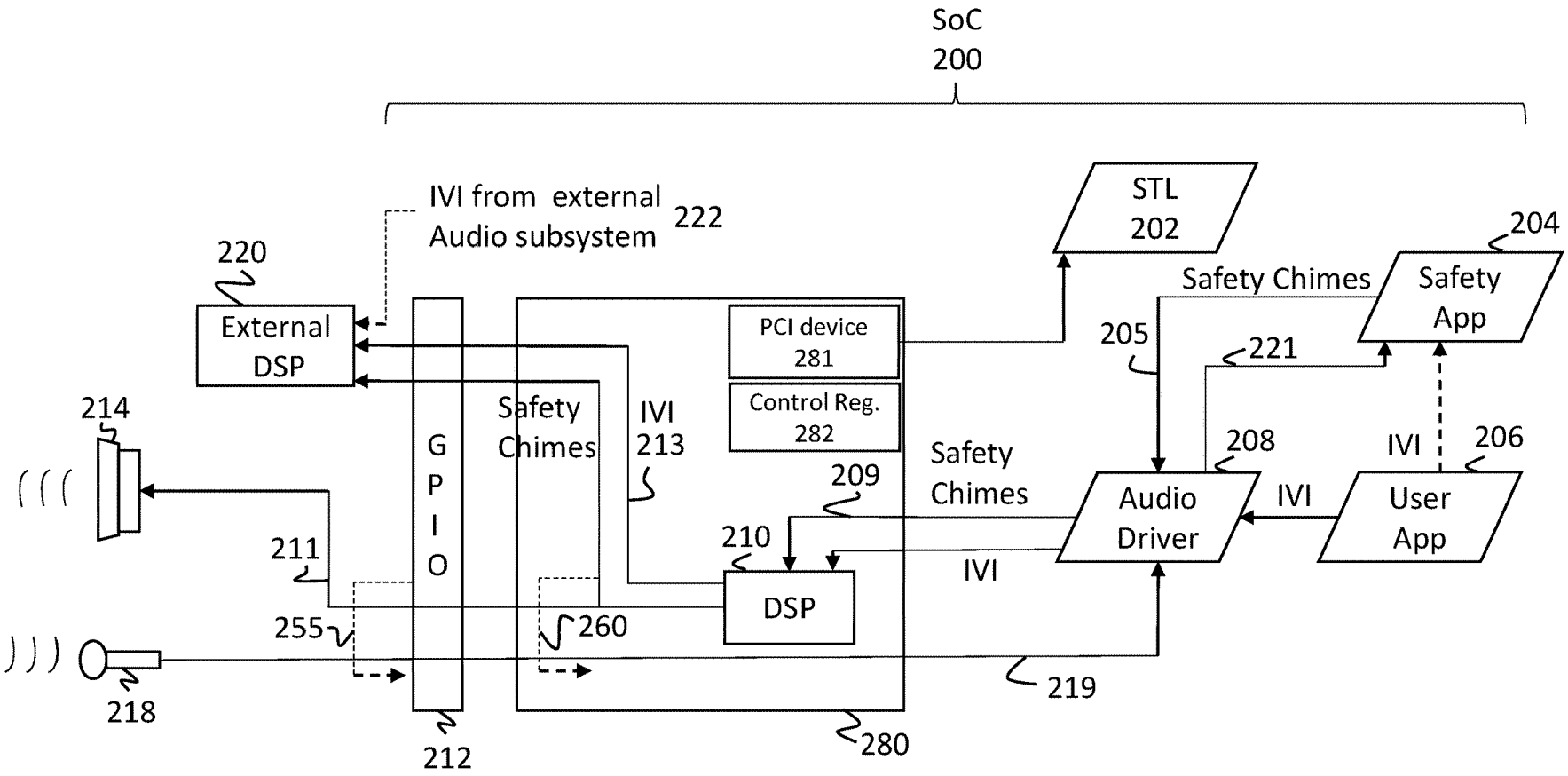
FIG. 3 illustrates an exemplary embodiment of the disclosure showing different return channels according to one or more embodiments of the disclosure.

FIG. 3 illustrates an exemplary embodiment of the disclosure showing different return channels according to one or more embodiments of the disclosure. Similar components are numbered similarly in FIGS. 2 and 3. The exemplary embodiment of FIG. 3 provides an architecture to enable a return channel on all audio interfaces including Synchronous Serial Port (SSP), Soundwire® and High-Definition Audio (HD-A). For example, for an SSP interface which is predominantly used in IoT applications, the disclosed features enable the capability to provide one or more optional return channels. The disclosed embodiments also provide multiple levels of validation which can be used independently or concurrently with each other.

In a first validation technique according to the disclosed embodiments an external loopback is provided. This embodiment is schematically illustrated at FIG. 3 as optional path 255. The loopback mode is available to loopback at board level. When using FuSa certified speakers, this method provides the full coverage as in the conventional speaker/microphone feedback described in relation to FIG. 2. In the loopback mode, the transmit path is the same as in FIG. 2. The receive path is different as is schematically illustrated as optional loopback path 255. The receive path draws a signal from the transmit pins of the GPIO 212 to send a signal directly to receive line 219. Line 219 may be associated with microphone 218. The signal is then directed to audio driver 208 via line 219. The audio driver relays the received signal to Safety App. 204 through line 221. Safety app 204 then confirms delivery of the transmitted FuSa warning chime. In one embodiment of the disclosure, the loopback mode does not provide a dedicated input path and the IO pins that are used may not be used for other functions in that mode.

Another validation technique according to the disclosed embodiments is the internal loopback. This is schematically illustrated in FIG. 3 as optional path 260. In one embodiment, the internal loopback provides a return channel at digital controller 280. This embodiment provides an almost complete coverage of the SoC 200 without including the GPIO buffer 212. Typically, the functional testing of the GPIO buffers are covered via IO Built-in Self-Test (BIST). Hence, the loopback technique may be used for both chime verification and platform validation. The chime speakers are typically FuSa grade. The FuSa grade speakers are checked during Key-ON or Key-OFF phase. Additional testing and verification are not necessary during runtime, thereby making the internal loopback a suitable verification option.

Referring again to FIG. 3, the safety chime signal is relayed from transmission path 211 to receive path 219 at controller 280 (and after digital signal processing 210). The feedback is then directed to audio driver 208 and then to safety app 204 via line 221. The transmission of the safety chime may then be confirmed at the safety App 204.

Still another validation technique according to the disclosed embodiments is through an external DSP device. The external DSP is schematically illustrated in FIG. 3 as device 220. This mode may be enabled by an external FuSa-certified DSP device that can validate the safety chime. This method is complex at platform level and may include additional cost for the addition of the external device. In FIG. 3, the external DSP 220 may be devised to receive IVI from an external audio subsystem as shown in 222. The external audio subsystem is not shown in FIG. 3. External DSP 220 may also receive internal IVI 213 as well as safety chimes 260 from DSP 210.

Thus, in one implementation, Safety App 204 generates one or more safety warning chimes. The transmit path (i.e., paths 205, 209 and 211, FIG. 3) shows how a safety chime is generated and transmitted through speaker 214.

Optional verification/validation paths (i.e., 260, 255, FIG. 3) along with over the air coupling (250, FIGS. 2, 3) between speakers and microphone show coupling from the transmit path to receive path (i.e., 219 and 221, FIG. 3). The receive path shows how the safety chime is communicated back to the Safety App—closing the validation/verification loop.

Among others, the disclosed architecture supports capability register exposure. Digital controller 280 in FIG. 3 may include a Peripheral Component Interconnect (PCI) device and STL 202 may access over a PCI bus (not shown) to program Base Address Registers (BARs) and may access FuSa registers for programming. Therefore, software STL 202 can access digital controller 280 through PCI device 280 to read Control Registers 282 and discover the capability of return path feature. The policy and the configuration can be set and enabled by BIOS (not shown), which could be configured based on the Original Equipment Manufacturer (OEM) or a predefined FuSa policy's platform needs. Alternatively, the policies can be set by SW STL 202. The Control Registers 280 can be enabled as needed for FuSa or platform validation.

In FuSa mode, the Service or Safety OS (residing at safety App 204) which handles the safety chime is required to validate the chime delivery path. This can be enabled by detecting the chime warning sound in the return path. If done in DSP 210, this method is highly computation intensive and needs to account for all the severity levels of warning chimes. Based on OEM and the platform in use, there may be many chime patterns that need to be verified on top of any noise injection, if over the air feedback 250 of FIG. 2 is used.

As described, the so-called internal loopback provides a reliable path for chime verification. It also provides an additional option for software STL to validate the chime delivery. In one embodiment, a fixed data pattern may be used in conjunction with the internal loopback. Here, the fixed data pattern can be transmitted before the warning chimes and the internal loopback will check the path on receive path by either DSP FW or Host SW.

In another embodiment, a fixed pattern can be transmitted before the warning chimes and the local shift registers on the transmit path may validate the checksum. The fixed pattern may be one or more data bits (e.g., data packet) that are transmitted ahead of the safety warning signal. That is, in certain embodiments, the fixed-pattern header may precede the safety warning signal data. In some embodiments, the fixed pattern may be deemed as a header to the safety warning signal.

The fixed-pattern header may be received at DSP 210 and reported back to Safety App. 204 (or optionally, STL 202); the pattern may then be compared with the known fixed-pattern header transmitted by Safety App. 204 to confirm FuSa signal's transmission. In another embodiment, the same methodology may be implemented at the SoC. That is, DSP 210 may receive the fixed-pattern header and either directly confirm a match between the received fixed-pattern header or communicate the received fixed-pattern header to Safety App. 204 (or optionally STL 202) for FuSa verification.

In another embodiment, an external DSP may communicate the fixed-pattern header to an SoC integrated Safety Test Library (STL) 202 and a comparison can be made between the revived fixed pattern-header and the fixed pattern-header originated from the Safety Application. The comparison between the fixed-pattern headers may help provide required validation and/or verification.

In one application, the local registers 282 may comprise a Multiple Input Shift Register (MISR) to validate the checksum. The MISR may be a cyclic redundancy checker (CRC) that uses a fixed polynomial to validate the input pattern. The polynomial and the fixed input patterns may be pre-selected based on safety policies. When the IVI (in vehicle infotainment) signal is mixed with warning chimes, the tell-tale method may not be used and the checking can be done on the actual chime pattern on the return path.

In an exemplary embodiment, when the platform uses return path mode, the checker can either be hardware or DSP firmware or host software STL. When the tell-tale input pattern is used, the checker may compare the MISR or look for the input pattern in the return path. When the platform is actively mixing the IVI and the warning chimes, there may be an additional complexity and computing in FW or SW to separate the IVI stream and look for the pattern. For multiple chime patterns, the input reference pattern based on severity levels can be fed to the checker based on OEMs.

In an optional implementation, the pattern check may be done at STL 202. In another optional embodiment, the pattern check may be done at the audio driver 208. In such implementations, safety app 204 may feed the reference safety pattern to STL 202 or Safety App. 204 for comparison.

While the above embodiments have been illustrated with reference to FuSa applications, the disclosed embodiments are not limited thereto. The disclosed embodiments can be used, for example, for platform validation, or for system debug. The cost saving in HVM platform validate for all IOs can be rather significant. The disclosed embodiments address this shortcoming with little or no upfront investment.

In another embodiment, the disclosed principles may be applied to Internet of Things (IoT) devices to create a chirp-like test pattern and capture the response/delivery over the air, thereby covering end to end paths towards the end of the boot process. The disclosed principles also minimize the cost of debugging in case where hundreds or thousands of devices are deployed in an industrial floor or building.

Figure 4:
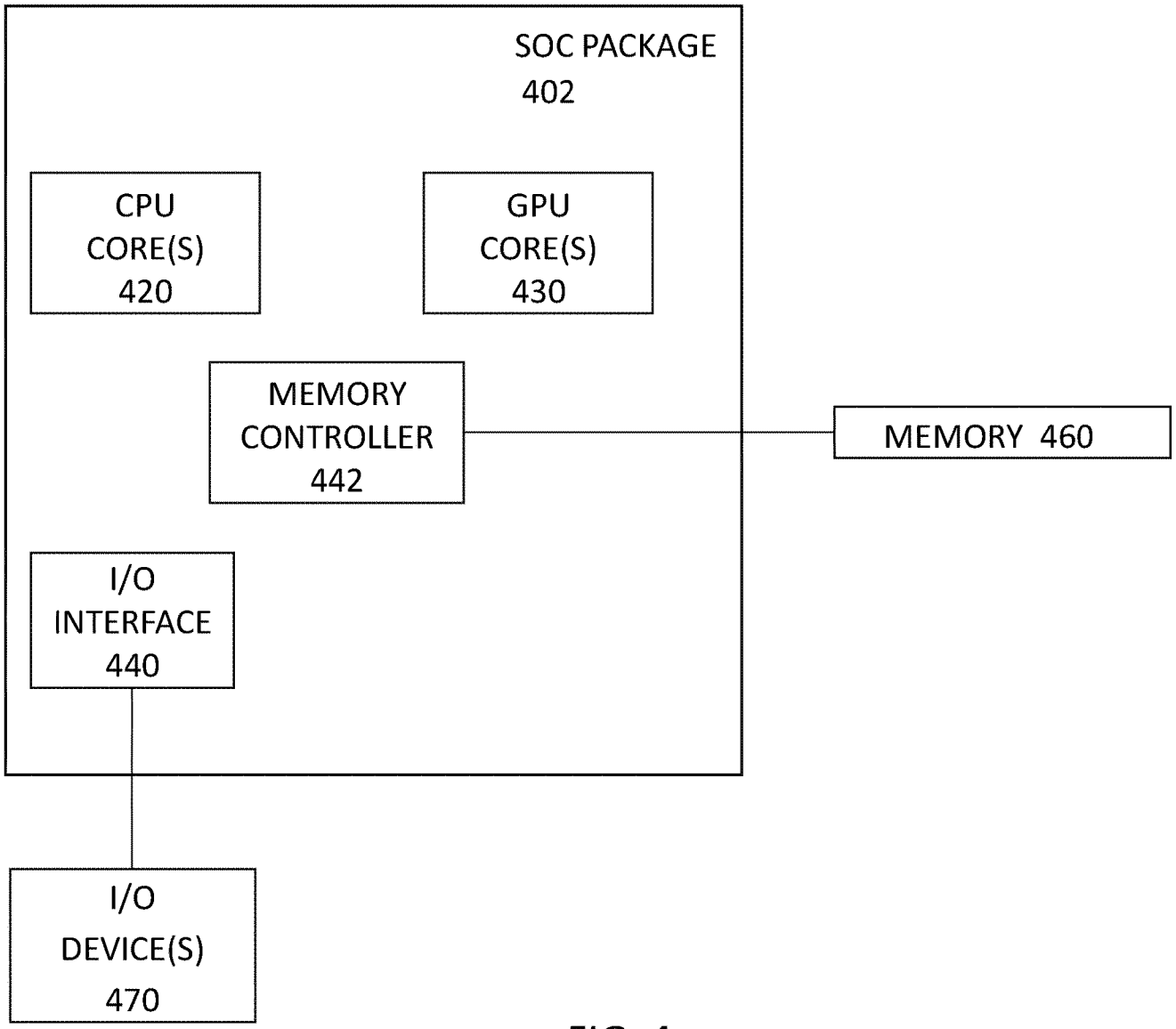
FIG. 4 illustrates a block diagram of a System-on-Chip (SOC) package in accordance with an embodiment of the disclosure.

FIG. 4 illustrates a block diagram of an SOC package in accordance with an embodiment. By way of example, SOC package 402 may be used to implement the FuSa safety warning signal (or chime) validation discussed above. SOC 402 includes one or more Central Processing Unit (CPU)

cores 420, one or more Graphics Processor Unit (GPU) cores 430, an Input/Output (I/O) interface 440, and a memory controller 442. Various components of the SOC package 402 may be coupled to an interconnect or bus such as discussed herein with reference to the other figures. Also, the SOC package 402 may include more or less components, such as those discussed herein with reference to the other figures. Further, each component of the SOC package 420 may include one or more other components, e.g., as discussed with reference to the other figures herein. In one embodiment, SOC package 402 (and its components) is provided on one or more Integrated Circuit (IC) die, e.g., which are packaged into a single semiconductor device.

SOC package 402 may be coupled to a memory 460 via the memory controller 442. Though not shown, memory 460 (or a portion of it) can be integrated on the SOC package 402. Memory 402 may store instructions executable on CPU Cores 420 or GPU Cores 430. The instructions may cause SoC package 402 to implement the FuSa validation steps according to certain disclosed embodiments.

The I/O interface 440 may be coupled to one or more I/O devices 470, e.g., via an interconnect and/or bus such as discussed herein with reference to other figures. I/O interface and I/O devices may be optionally integrated into the SoC 402. I/O device 470 may be integrated into SoC package 402 as General Purpose I/O (GPIO). In certain embodiments, an external I/O device(s) 470 may include one or more of a keyboard, a mouse, a touchpad, a display, an image/video capture device (such as a camera or camcorder/video recorder), a touch screen, a speaker, or the like.

Figure 5:
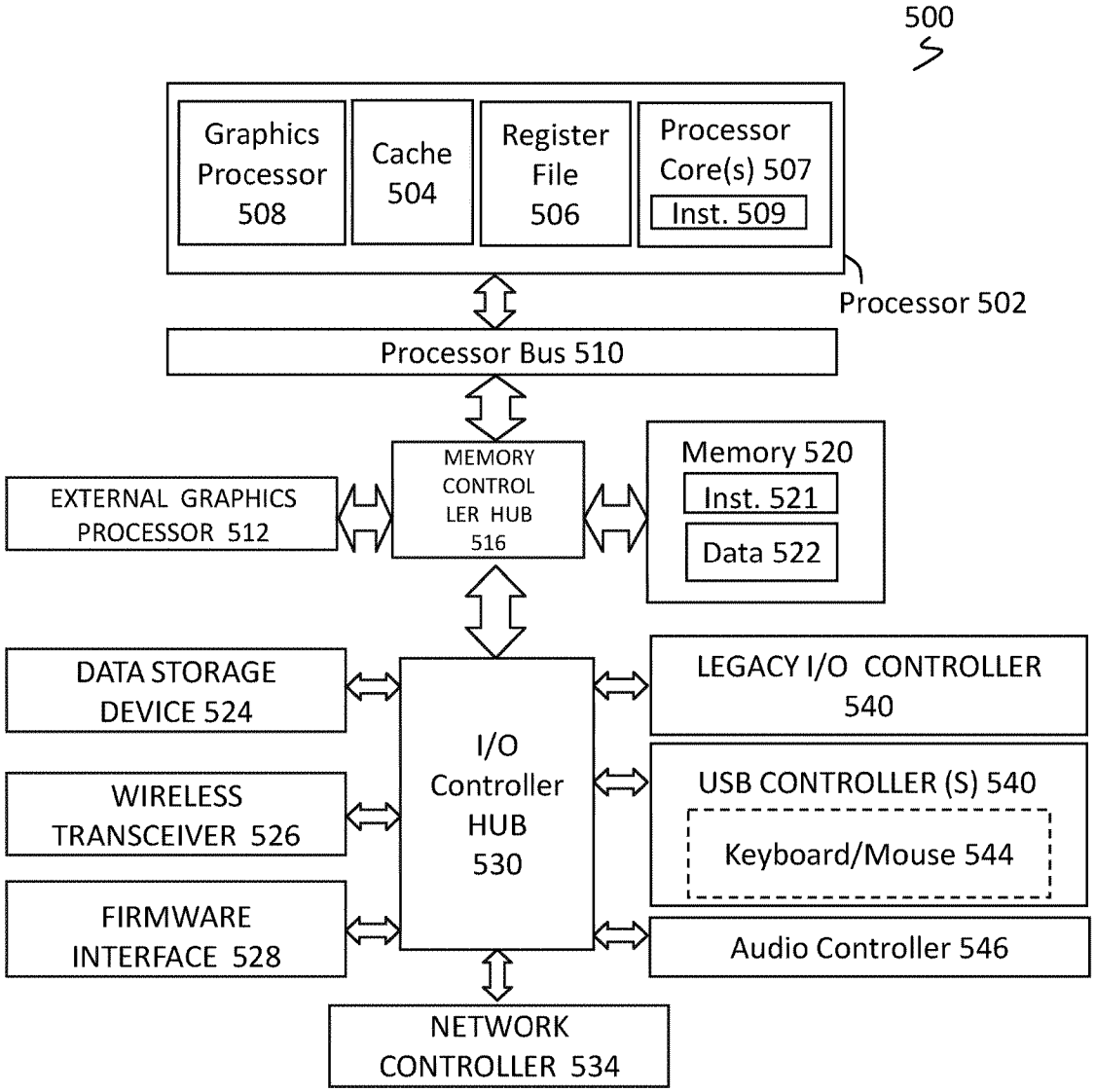
FIG. 5 is a block diagram of a processing system 500, according to an embodiment.

SoC package 402 may be part of a larger circuitry such as a board, an integrated circuit or a processing system. FIG. 5 is a block diagram of a processing system 500, according to an embodiment of the disclosure. In various embodiments the system 500 includes one or more processors 502 and one or more graphics processors 508, and may be a single processor desktop system, a multiprocessor workstation system, or a server system having a large number of processors 502 or processor cores 507. In on embodiment, the system 500 is a processing platform incorporated within a system-on-a-chip (SoC or SOC) integrated circuit for use in mobile, handheld, or embedded devices.

An embodiment of system 500 can include, or be incorporated within a server-based gaming platform, a game console, including a game and media console, a mobile gaming console, a handheld game console, or an online game console. In some embodiments system 500 is a mobile phone, smart phone, tablet computing device or mobile Internet device. Data processing system 500 can also include, couple with, or be integrated within a wearable device, such as a smart watch wearable device, smart eyewear device, augmented reality device, or virtual reality device. In some embodiments, data processing system 500 may be used in an autonomous (or semi-autonomous) vehicle, robotics or other IoT devices.

In some embodiments, the one or more processors 502 each include one or more processor cores 507 to process instructions which, when executed, perform operations for system and user software. In some embodiments, each of the one or more processor cores 507 is configured to process a specific instruction set 509. In some embodiments, instruction set 509 may facilitate Complex Instruction Set Computing (CISC), Reduced Instruction Set Computing (RISC), or computing via a Very Long Instruction Word (VLIW). Multiple processor cores 507 may each process a different instruction set 509, which may include instructions to facilitate the emulation of other instruction sets. Processor core 507 may also include other processing devices, such a Digital Signal Processor (DSP).

In some embodiments, the processor 502 includes cache memory 504. Depending on the architecture, the processor 502 can have a single internal cache or multiple levels of internal cache. In some embodiments, the cache memory is shared among various components of the processor 502. In some embodiments, the processor 502 also uses an external cache (e.g., a Level-3 (L3) cache or Last Level Cache (LLC)) (not shown), which may be shared among processor cores 507 using known cache coherency techniques. A register file 506 is additionally included in processor 502 which may include different types of registers for storing different types of data (e.g., integer registers, floating point registers, status registers, and an instruction pointer register). Some registers may be general-purpose registers, while other registers may be specific to the design of the processor 502.

In some embodiments, processor 502 is coupled to a processor bus 510 to transmit communication signals such as address, data, or control signals between processor 502 and other components in system 500. In one embodiment the system 500 uses an exemplary 'hub' system architecture, including a memory controller hub 516 and an Input Output (I/O) controller hub 530. A memory controller hub 516 facilitates communication between a memory device and other components of system 500, while an I/O Controller Hub (ICH) 530 provides connections to I/O devices via a local I/O bus. In one embodiment, the logic of the memory controller hub 516 is integrated within the processor.

Memory device 520 can be a dynamic random-access memory (DRAM) device, a static random-access memory (SRAM) device, flash memory device, phase-change memory device, or some other memory device having suitable performance to serve as process memory. In one embodiment the memory device 520 can operate as system memory for the system 500, to store data 522 and instructions 521 for use when the one or more processors 502 executes an application or process. Memory controller hub 516 also couples with an optional external graphics processor 512, which may communicate with the one or more graphics processors 508 in processors 502 to perform graphics and media operations.

In some embodiments, ICH 530 enables peripherals to connect to memory device 520 and processor 502 via a high-speed I/O bus. The I/O peripherals include, but are not limited to, an audio controller 546, a firmware interface 528, a wireless transceiver 526 (e.g., Wi-Fi, Bluetooth), a data storage device 524 (e.g., hard disk drive, flash memory, etc.), and a legacy I/O controller 540 for coupling legacy (e.g., Personal System 2 (PS/2)) devices to the system. One or more Universal Serial Bus (USB) controllers 542 connect input devices, such as keyboard and mouse 544 combinations. A network controller 534 may also couple to ICH 530. In some embodiments, a high-performance network controller (not shown) couples to processor bus 510. It will be appreciated that the system 500 shown is exemplary and not limiting, as other types of data processing systems that are differently configured may also be used. For example, the I/O controller hub 530 may be integrated within the one or more processor 502, or the memory controller hub 516 and I/O controller hub 530 may be integrated into a discreet external graphics processor, such as the external graphics processor 512.

Additional Notes & Examples

The following exemplary embodiments are further provided to illustrate different applications of the disclosed principles. The exemplary embodiments are non-limiting.

Example 1 is directed to an apparatus to validate operation of a Functional Safety (FuSa) platform through delivery of a safety warning signal, the apparatus comprising: a Safety Application to issue a safety warning signal, the safety warning signal configured for audio delivery to an audience, a transmit path in communication with the Safety Application to transmit the safety warning signal; and a digital controller circuitry to communicate with the transmit path, the digital controller circuitry configured to detect the safety warning signal at the transmit path and provide a loopback to communicate and validate transmission of the detected safety warning signal to the Safety Application; wherein the transmit path, the Safety Application and the DSP circuitry are integrated on a System-on-Chip (SoC).

Example 2 is directed to the apparatus of example 1, wherein the Safety Application is further configured to validate operation of the FuSa platform upon receipt of the detected safety warning signal.

Example 3 is directed to the apparatus of example 1, further comprising an input/output bus to receive and communicate the receipt of the safety warning signal to the Safety Application, wherein the input/output bus is integrated on the SoC.

Example 4 is directed to the apparatus of example 1, further comprising an external DSP circuitry to with the SoC, the external DSP circuitry configured to receive the safety warning signal from the SoC and to provide an external indication of receipt of the safety warning signal to validate FuSa operation.

Example 5 is directed to the apparatus of example 1, further comprising an external DSP circuitry in communication with the SoC, the external DSP circuitry configured to receive the safety warning signal from the SoC and to provide an indication of receipt of the safety warning signal to the Safety Application to validate FuSa operation.

Example 6 is directed to at least one non-transitory machine-readable medium comprising instructions that, when executed by computing hardware, including a processor circuitry coupled to a memory circuitry, cause the computing hardware of a System-on-Chip (SoC) to: issue a safety warning signal from a Safety Application of the platform, the safety warning signal configured for audio delivery to an audience, transmit the safety warning signal through a transmit path, the transmit path further comprising an audio driver and a digital signal processing (DSP) circuitry in communication with the Safety Application, detect the safety warning signal on the transmit path of the SoC; communicate the detected safety warning signal back to the Safety Application through a receive loopback: and confirm communication of the safety warning signal; wherein the transmit path, the receive loopback, the Safety Application and the DSP circuitry are integrated on the SoC.

Example 7 is directed to the medium of example 6, wherein the instructions further cause the SoC to receive the safety warning signal at the DSP circuitry and communicate receipt of the safety warning signal from the DSP to the Safety Application.

Example 8 is directed to the medium of example 6, wherein the instructions further cause the SoC to receive the safety warning signal at an SoC input/output bus and to communicate the receipt to the safety warning signal from the SoC input/output bus to the Safety Application.

Example 9 is directed to the medium of example 6, wherein the safety warning signal further comprises a fixed-pattern header followed by the safety warning signal data.

Example 10 is directed to the medium of example 6, wherein the instructions further cause the SoC to receive the safety warning signal at an external DSP circuitry and to confirm receipt thereof to an SoC integrated Safety Test Library (STL).

Example 11 is directed to the medium of example 9, wherein the instructions further cause the SoC to transmit the fixed-pattern header and the safety warning signal data to an external DSP, receive from the external DSP a receipt indication of the fixed-pattern header and compare the receipt indication of the fixed-pattern header with the transmitted fixed-pattern header from the Safety Application to validate a transmission operation.

Example 12 is directed to the medium of example 9, wherein the instructions further cause the SoC to transmit the safety warning signal to a speaker for audible playback and receive an indication of the playback through an external microphone.

Example 13 is directed to a method to validate operation of a Functional Safety (FuSa) System-on-Chip (SoC) platform through delivery of a warning signal, the method comprising: issuing a safety warning signal at a Safety Application of the platform, the safety warning signal configured for audio delivery to an audience; transmitting the safety warning signal through a transmit path, the transmit path further comprising an audio driver and a digital signal processing (DSP) circuitry in communication with the Safety Application; detecting the safety warning signal on the transmit path of the SoC; communicating the detected safety warning signal back to the Safety Application; and confirming communication of the safety warning signal; wherein the transmit path, the receive path, the Safety Application and the DSP circuitry are integrated on the SoC.

Example 14 is directed to the method of example 13, wherein confirming communication of the safety warning signal further comprises receiving the safety warning signal at the DSP circuitry and communicating receipt of the safety warning signal from the DSP to the Safety Application.

Example 15 is directed to the method of example 13, wherein confirming communication of the safety warning signal further comprises receiving the safety warning signal at an SoC input/output bus and communicating the receipt to the safety warning signal from SoC the input/output bus to the Safety Application.

Example 16 is directed to the method of example 13, wherein the safety warning signal further comprises a fixed-pattern header followed by the safety warning signal data.

Example 17 is directed to the method of example 13, wherein confirming communication of the safety warning signal further comprises receiving the safety warning signal at an external DSP circuitry and confirming receipt thereof to an SoC integrated Safety Test Library (STL).

Example 18 is directed to the method of example 16, further comprising receiving the fixed-pattern header and the safety warning signal data at an external DSP, communicating an indication of receipt of the fixed-pattern header from the external DSP to an SoC integrated Safety Test Library (STL) and validating transmission of the safety warning signal.

Example 19 is directed to the method of example 13, further comprising audibly transmitting the safety warning signal, detecting the audible safety warning signal at a microphone and communicating the received safety warning signal back to the Safety Application.

In the description and claims, the terms "coupled" and "connected," along with their derivatives, may be used. In some embodiments, "connected" may be used to indicate that two or more elements are in direct physical or electrical contact with each other. "Coupled" may mean that two or more elements are in direct physical or electrical contact. However, "coupled" may also mean that two or more elements may not be in direct contact with each other, but may still cooperate or interact with each other.

While the principles of the disclosure have been illustrated in relation to the exemplary embodiments shown herein, the principles of the disclosure are not limited thereto and include any modification, variation or permutation thereof.

What is claimed is:

1. An apparatus to validate operation of a Functional Safety (FuSa) platform through delivery of a safety warning signal, the apparatus comprising:

a Safety Application to issue a safety warning signal, the safety warning signal configured for real-time audio feedback to a human audience;

a transmit path in communication with the Safety Application to transmit the safety warning signal, the transmit path further comprising an Input/Output (I/O) bus with at least one dedicated I/O pin; and a digital controller circuitry to communicate with the transmit path, the digital controller circuitry configured to detect the safety warning signal at the at least one dedicated I/O pin and provide a loopback to communicate and validate transmission of the detected safety warning signal to the Safety Application;

wherein the transmit path, I/O bus, the Safety Application and the digital controller circuitry are integrated on a System-on-Chip (SoC); and wherein the at least one dedicated I/O pin is exclusive to the FuSa platform validation operation.

2. The apparatus of claim 1, wherein the Safety Application is further configured to validate operation of the FuSa platform upon receipt of the detected safety warning signal.

3. The apparatus of claim 1, I/O bus is configured to receive and communicate the receipt of the safety warning signal to the Safety Application through a receive path.

4. The apparatus of claim 1, further comprising an external DSP circuitry to communicate with the SoC, the external DSP circuitry configured to receive the safety warning signal from the SoC and to provide an external indication of receipt of the safety warning signal to validate FuSa operation.

5. The apparatus of claim 1, further comprising an external DSP circuitry in communication with the SoC, the external DSP circuitry configured to receive the safety warning signal from the SoC and to provide an indication of receipt of the safety warning signal to the Safety Application to validate FuSa operation.

6. At least one non-transitory machine-readable medium comprising instructions that, when executed by computing hardware, including a processor circuitry coupled to a memory circuitry, cause the computing hardware of a System-on-Chip (SoC) to:

issue a safety warning signal from a Safety Application of the platform, the safety warning signal configured for audio delivery to a human audience;

transmit the safety warning signal through a transmit path, the transmit path further comprising an audio driver, an Input/Output (TO) bus with at least one dedicated I/O pin, and a digital signal processing (DSP) circuitry in communication with the Safety Application;

detect the safety warning signal at the dedicated I/O pin;

communicate the detected safety warning signal back to the Safety Application; and confirm communication of the safety warning signal;

wherein the transmit path, the I/O bus, the Safety Application and the DSP circuitry are integrated on the SoC; and wherein the at least one dedicated I/O pin is exclusive to the FuSa platform validation operation.

7. The medium of claim 6, wherein the instructions further cause the SoC to receive the safety warning signal at the DSP circuitry and communicate receipt of the safety warning signal from the DSP to the Safety Application.

8. The medium of claim 6, wherein the instructions further cause the SoC to receive the safety warning signal at an SoC input/output bus and to communicate the receipt to the safety warning signal from the SoC input/output bus through a receive loopback.

9. The medium of claim 6, wherein the safety warning signal further comprises a fixed-pattern header followed by the safety warning signal data.

10. The medium of claim 6, wherein the instructions further cause the SoC to receive the safety warning signal at an external DSP circuitry and to confirm receipt thereof to an SoC integrated Safety Test Library (STL).

11. The medium of claim 9, wherein the instructions further cause the SoC to transmit the fixed-pattern header and the safety warning signal data to an external DSP, receive from the external DSP a receipt indication of the fixed-pattern header and compare the receipt indication of the fixed-pattern header with the transmitted fixed-pattern header from the Safety Application to validate a transmission operation.

12. The medium of claim 9, wherein the instructions further cause the SoC to transmit the safety warning signal to a speaker for audible playback and receive an indication of the playback through an external microphone.

13. A method to validate operation of a Functional Safety (FuSa) System-on-Chip (SoC) platform through delivery of a warning signal, the method comprising:

issuing a safety warning signal at a Safety Application of the platform, the safety warning signal configured for audio delivery to a human audience;

transmitting the safety warning signal through a transmit path, the transmit path further comprising an audio driver, an Input/Output (I/O) bus with a at least one dedicated I/O pin and a digital signal processing (DSP) circuitry in communication with the Safety Application;

detecting the safety warning signal at the at least one dedicated I/O pin;

communicating the detected safety warning signal back to the Safety Application through a receive path; and confirming communication of the safety warning signal;

wherein the transmit path, the I/O bus, the receive path, the Safety Application and the DSP circuitry are integrated on the SoC;

and wherein the at least one dedicated I/O pin is exclusive to the FuSa platform validation operation.

14. The method of claim 13, wherein confirming communication of the safety warning signal further comprises receiving the safety warning signal at the DSP circuitry and communicating receipt of the safety warning signal from the DSP to the Safety Application.

15. The method of claim 13, wherein confirming communication of the safety warning signal further comprises receiving the safety warning signal at one or more pins of the I/O bus.

16. The method of claim 13, wherein the safety warning signal further comprises a fixed-pattern header followed by the safety warning signal data.

17. The method of claim 13, wherein confirming communication of the safety warning signal further comprises receiving the safety warning signal at an external DSP circuitry and confirming receipt thereof to an SoC integrated Safety Test Library (STL).

18. The method of claim 16, further comprising receiving the fixed-pattern header and the safety warning signal data at an external DSP, communicating an indication of receipt of the fixed-pattern header from the external DSP to an SoC integrated Safety Test Library (STL) and validating transmission of the safety warning signal.

19. The method of claim 13, further comprising audibly transmitting the safety warning signal, detecting the audible safety warning signal at a microphone and communicating the received safety warning signal back to the Safety Application.

* * * * *